US006059015A

United States Patent [19]

Bewlay et al.

[11] Patent Number: 6,059,015

[45] **Date of Patent: *May 9, 2000**

[54] METHOD FOR DIRECTIONAL SOLIDIFICATION OF A MOLTEN MATERIAL AND APPARATUS THEREFOR

[75] Inventors: Bernard Patrick Bewlay; Dennis Joseph Dalpe, both of Schenectady, N.Y.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/882,891

[22] Filed: Jun. 26, 1997

[51] Int. Cl.[7] ..... B22D 27/02; B22D 27/04

[52] U.S. Cl. ..... 164/493; 164/122.1; 164/498; 164/513

[58] Field of Search ..... 164/471, 493, 164/498, 466, 502, 507, 513, 122.1, 122.2

[56] References Cited

U.S. PATENT DOCUMENTS

| | | | |
|---|---|---|---|
| 3,702,368 | 11/1972 | Hukin . | |
| 4,058,668 | 11/1977 | Clites | 13/32 |
| 4,082,207 | 4/1978 | Garnier et al. | 222/594 |
| 4,617,979 | 10/1986 | Suzuki et al. | 164/461 |
| 4,729,422 | 3/1988 | Ernst et al. | 164/465 |
| 4,762,653 | 8/1988 | Senillou et al. | 264/22 |

FOREIGN PATENT DOCUMENTS

| | | | |
|---|---|---|---|
| 53-57127 | 5/1978 | Japan | 164/122.1 |
| 3-130328 | 6/1991 | Japan | 164/471 |
| 4-162954 | 6/1992 | Japan | 164/471 |
| 5-38555 | 2/1993 | Japan | 164/471 |
| 2207060 | 1/1989 | Norway . | |
| 480493 | 5/1976 | U.S.S.R. | 164/122.1 |

OTHER PUBLICATIONS

Nagy El–Kaddah, Thomas Piwonka & John Berry; A New Containerless Melting Process for Investment Casting.

P.G. Clites; The Inductoslag Melting Process; Nov. 4, 1982.

K.M. Chang, B.P. Bellway, J.A. Sutliff & M.R. Jackson; Cold–Cricible Directional Solidification of Refractory Metal–Silicide Eutectics; Jun., 1992.

*Primary Examiner*—Kuang Y. Lin

*Attorney, Agent, or Firm*—Ernest G. Cusick; Noreen C. Johnson

[57] ABSTRACT

A method for directional solidification (DS) of a molten material, and an apparatus therefor. The method generally entails the use of a container having a base and peripheral wall that define an interior of the container, an induction coil for heating the contents of the container and generating an electromagnetic field, and means for controllably separating the container from the heating means and the electromagnetic field, such as by withdrawing the container from the heating means and electromagnetic field. Using such an apparatus, a material is heated within the container to yield a melt that is substantially prevented from contacting the wall of the container as a result of being at least partially levitated by the electromagnetic field. The container is then separated, e.g., withdrawn from the heating means and the electromagnetic field so as to cause directional solidification of the melt while the majority of the melt remains spaced apart from the wall of the container, yielding a directionally solidified article whose composition has not been significantly affected by reactions with the container. The invention is particularly directed to the production of DS ingots of high temperature materials containing one or more reactive elements.

15 Claims, 2 Drawing Sheets

METHOD FOR DIRECTIONAL SOLIDIFICATION OF A MOLTEN MATERIAL AND APPARATUS THEREFOR

FIELD OF THE INVENTION

This invention relates to directional solidification processes and apparatuses therefor. More particularly, this invention is directed to a method and apparatus for directionally solidifying high temperature reactive materials.

BACKGROUND OF THE INVENTION

Conventional methods of directional solidification (DS), such as that known in the art as the Bridgman technique, generally entail the use of silica-bonded alumina shell molds for high-temperature casting processes. The chemical reactivity of certain molten materials can seriously degrade ceramic molds during casting, and can cause contamination of the melt by the formation of oxide inclusions and increased interstitial concentrations. Such reactive materials can also degrade the ceramic crucibles in which the materials are melted prior to casting. The reactivity of such materials, including aluminum, titanium, niobium, etc., is the result of a low free energy of oxide formation. While melting and casting operations with reactive materials are performed in an inert atmosphere or vacuum to avoid reactions with gaseous oxygen, oxygen is generally nonetheless available from the mold or crucible as a result of the presence of less stable oxides in the ceramic mold and crucible materials. Significant degradation of the ceramic mold and crucible and contamination of the melt is even more likely to result when molten materials containing a high concentration of one or more reactive elements are in long-term contact with the mold or crucible, and particularly if such materials have a high melting temperature.

As a solution to the above, cold-wall crucible DS methods have been developed to produce ingots of very high temperature alloys and composites containing reactive elements. Of these, segmented, water-cooled copper crucibles whose contents are heated by induction have found use. As is known in the art, segmentation in the crucible wall enables induction heating to occur through the metal crucible walls by interrupting induced current flow in the walls that would otherwise attenuate the field of the induction coil. A slag can also be used between the melt and crucible walls to prevent reactions from occurring therebetween, as well as to prevent shorting between segments of the crucible walls.

As reported by Chang et al. in *Cold-Crucible Directional Solidification of Refractory Metal-Silicide Eutectics*, The Journal of the Minerals, Metals & Materials Society (JOM), Vol. 44, No. 6 (June 1992), pg. 59–63, directionally solidified high-temperature eutectic composites of reactive elements have been successfully grown with a segmented, water-cooled copper crucible in a vacuum or inert atmosphere. Induction coils used to heat the melt also serve to induce melt convection to promote homogeneous mixing, as well as levitate the melt away from the walls of the crucible. Levitation of the melt reduces the contact area between the melt and crucible and, therefore, reduces heat transfer and power loss to the crucible during the melting operation. Chang et al. then effected directional solidification by attaching a seed crystal to a water-cooled pulling rod, which was lowered into the melt. Withdrawal of the seed from the melt and crystal growth from the seed were controlled to achieve directional solidification, and rotation of the pulling rod during withdrawal was employed to maintain the symmetry of thermal conditions during directional solidification.

While the DS technique reported by Chang et al. has been successfully applied to many different alloy systems, yielding DS ingots with much less contamination than those processed through conventional mold-based DS methods, the technique is ultimately limited by the amount of material that can be processed in the crucible, with a maximum diameter being about ten millimeters for ingots produced by the technique. Furthermore, reactions between a melt and the crucible and a melt and the mold, and therefore degradation of the crucible and mold and contamination of the melt, are more likely with increasing reactive element content of the melt. Therefore, further improvements in directional solidification methods would be desirable, particularly in the production of directionally solidified high temperature materials containing reactive elements.

SUMMARY OF THE INVENTION

According to the present invention, there is provided a method for directional solidification (DS) of a molten material, and an apparatus for carrying out the DS process. The invention is particularly directed to the production of large DS ingots of high temperature materials containing one or more reactive elements. As used herein, reactive elements will be understood to mean those elements that react with or dissolve species that constitute the crucible or mold, such as silicon, aluminum, calcium, oxygen and magnesium. Furthermore, "large" ingots are those generally having a diameter of about 32 millimeters and more.

The method of this invention generally entails the use of a container having a base and wall that define an interior of the container, means for heating the contents of the container, means for generating an electromagnetic field, and means for separating the container from the heating means and the electromagnetic field, such as by withdrawing the container from the heating means and electromagnetic field. Using such an apparatus, the method of this invention generally includes the steps of melting a material within the container to yield a melt that is substantially prevented from contacting the wall of the container by the electromagnetic field. The container is then separated, e.g., withdrawn, from the heating means and the electromagnetic field so as to cause directional solidification of the melt while the melt remains spaced apart from the wall of the container, yielding a directionally solidified article whose composition has not been affected by any reactions with the container.

The method of this invention as recited above is well suited for directionally solidifying highly reactive materials, and particularly high temperature reactive metal-base alloys, e.g., those having a melting temperature of greater than 1700° C. Depending on the composition of the melt, the resulting DS article can be monolithic or an in-situ composite material characterized by a strengthening phase directionally oriented in a more ductile matrix. Furthermore, the method of this invention is capable of producing DS ingots having a diameter of up to about 300 millimeters or more.

In view of the above, it can be seen that a significant advantage of this invention is that a highly reactive, high-temperature material can be directionally solidified, yielding a DS article that is essentially free of contaminants that would otherwise be introduced as a result of the reactivity of the material with the container. A conventional mold is completely eliminated by the method of this invention, such that contact with the melt and the resulting article is limited to the container in which the material is melted. Because contact with the container remains minimal and consistent throughout the process, reactive materials having melting temperatures of 1900° C. and greater can be successfully produced by the method of this invention.

Other aspects and advantages of this invention will be better appreciated from the following detailed description.

DETAILED DESCRIPTION OF THE INVENTION

The present invention is generally applicable to materials having high melting temperatures, e.g., above 1700° C., and to reactive materials that are difficult to melt and mold without adverse reactions occurring that produce contaminants in the melt. The present invention is a method for directionally solidifying such high temperature and reactive materials without contamination of the material and without significant degradation of the vessels used to contain the molten material.

Figure 1:
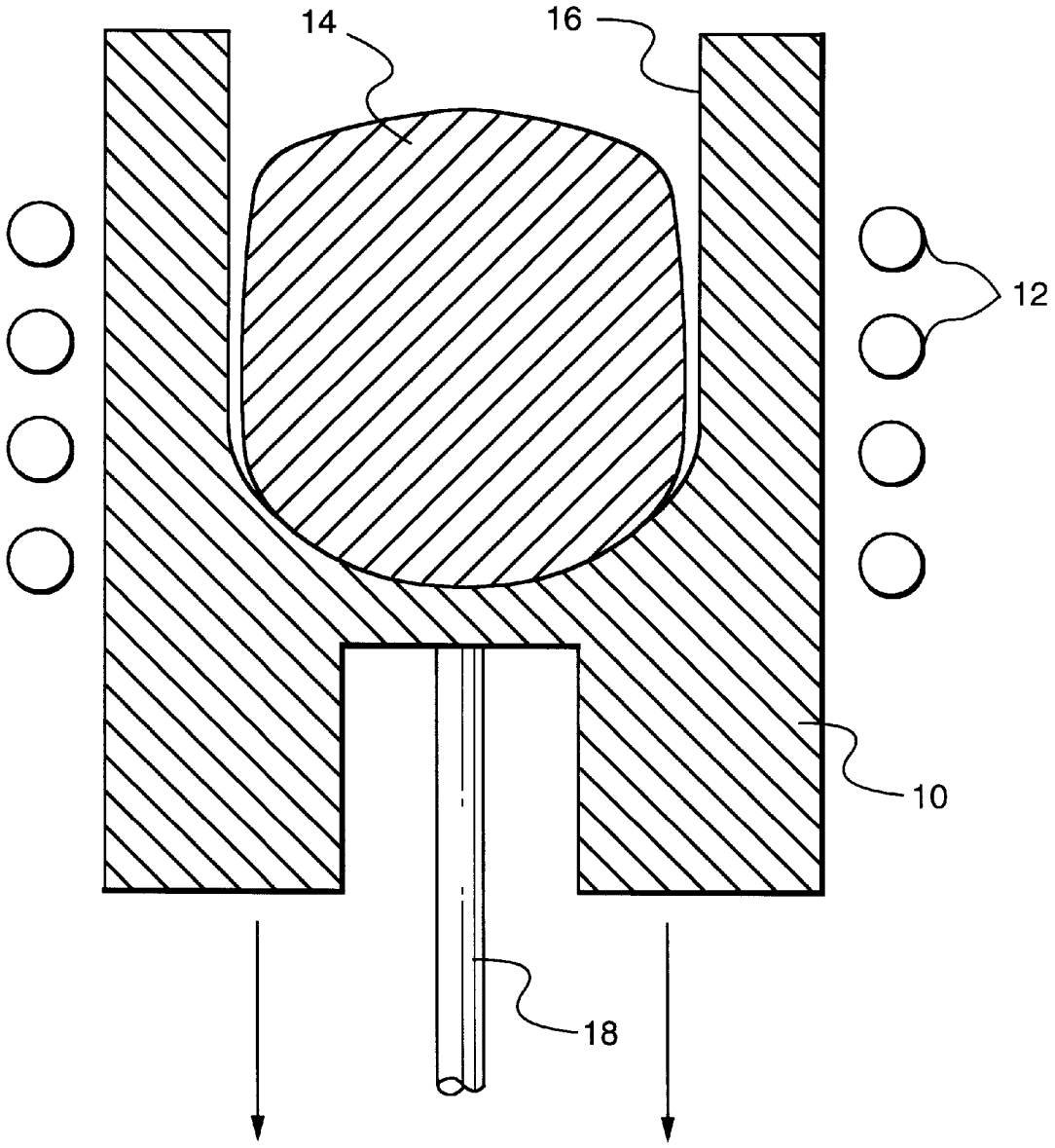
FIG. 1 is a schematic of a directional solidification apparatus for use in the method of this invention.
Figure 2:
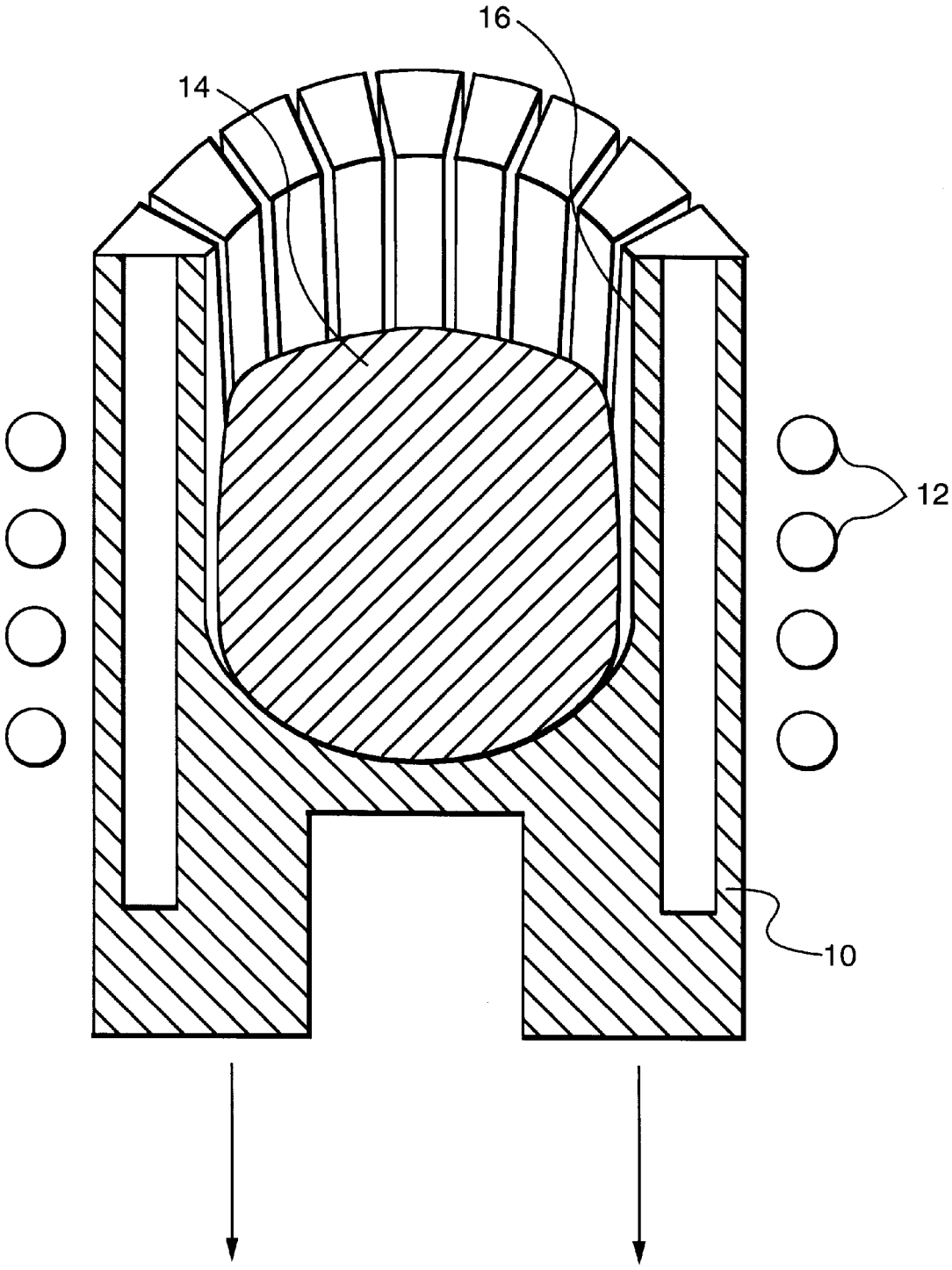
FIG. 2 is a schematic of a directional solidification apparatus with a vertical, multiple-segment, cold-walled, water-cooled, copper crucible container.

An apparatus for carrying out the method of this invention is schematically represented in FIG. 1 as including a container 10 coaxially surrounded by an induction heating coil 12. The container 10 is typically a crucible, preferably a vertical multiple segment cold-wall (e.g., water-cooled) copper crucible of a type known in the art, as illustrated in FIG. 2, where like components are labeled with like reference characters. A melt 14 of a high temperature and/or reactive material is represented as being contained within the container 10, but spaced apart from a peripheral wall 16 of the container 10. The original charge of material is melted by induction heating using the coil 12, which is operated at a level sufficient to also generate an electromagnetic field that will at least partially levitate the melt 14, as depicted in FIG. 1. In accordance with this invention, the frequency range required for generating the electromagnetic field is about 5 kHz to about 500 kHz, with a preferred range of about 10 kHz to 400 kHz. The melt 14 is preferably resolidified and remelted several times to ensure homogeneity prior to directional solidification. As indicated by the arrows in FIG. 1, directional solidification is achieved by lowering the container 10, e.g., on a support shaft 18, so as to separate and withdraw the container 10 from the electromagnetic field generated by the coil 12. Alternatively, the coil 12 can be raised to withdraw the crucible 10 from the electromagnetic field. According to this invention, the movement of the container 10 relative to the coil 12 is closely regulated to occur at a rate that causes directional solidification of the melt 14 in a controlled manner.

As is apparent from the above, the method of this invention is highly suited for directional solidification of high temperature and reactive materials. Examples of materials that can be processed in accordance with the above include refractory metals and their alloys, and refractory metal composites characterized by a metal phase and an intermetallic reinforcing phase. Examples of the latter include refractory metal-silicide compositions, particularly binary eutectics of refractory metal-silicide alloys such as Cr—$Cr_3Si$, Nb—$Nb_3Si$ and V—$V_3Si$, and a niobium-base in-situ composite disclosed in copending U.S. patent application Ser. No. 08/538,152, assigned to the assignee of the present invention. Directionally solidified bar stock of these materials are candidates for the manufacture of air foils and other structural components of gas turbine engines, as well as other applications that require strength and environmental resistance at high temperatures.

To illustrate the method of this invention, a charge of about 150 grams of a Nb-18.2Si (atomic percent) eutectic alloy, having a melting temperature of about 1880° C., was induction melted in a segmented water-cooled crucible with an internal diameter of about thirty-two millimeters. An induction coil coaxially surrounded the crucible, generally as indicated in FIG. 1. The induction coil was connected to a 50 kW, 200 kHz induction supply, which was operated at a power level of about 30 kW to both melt and levitate the resulting melt. During levitation, contact between the melt and the crucible was limited to the base of the crucible, as generally illustrated FIG. 1. The charge was solidified by reducing the induction power, and then remelted three times in order to ensure homogeneity of the melt.

The crucible was then withdrawn from the induction coil, and therefore simultaneously from the heated zone and the electromagnetic field generated by the induction coil. Withdrawal was carefully controlled to a rate of about five millimeters per minute, yielding a directionally solidified Nb—$Nb_3Si$ in-situ composite bar having a diameter of about thirty-two millimeters, a length of about thirty millimeters, and a microstructure characterized by grains of about one millimeter in diameter oriented parallel to the direction of crucible withdrawal from the electromagnetic field. Other testing was performed at withdrawal rates of about three to about ten millimeters per minute, with successful results. Based on these tests, it is foreseeable that acceptable results can be obtained with withdrawal rates of about one to about thirty millimeters per minute. Rates below about one millimeter/minute can lead to volatilization of elements that are required in the DS casting, while rates above about thirty millimeters/minute can lead to microstructural defects, such as micro and macroporosity or cracking.

While a eutectic Nb—Si alloy was employed in the above tests, Nb—Si alloys with compositions in the range of about Nb-10Si to Nb-25Si can be directionally solidified in the described manner. Furthermore, more complex ternary, quaternary and higher order alloys can also be directionally solidified with the method of this invention. Accordingly, one skilled in the art will appreciate that the method of this invention is applicable to the manufacture of directionally solidified bar stock of a wide variety of high melting temperature monolithic and in-situ composite materials. The length of the stock produced by this invention can be increased above that noted in the example by using a longer crucible, longer induction coil and a higher power induction supply, together with appropriate furnace control. Similarly, the diameter of the stock can be greater than that reported in the example by increasing the crucible diameter, with diameters of up to about 300 millimeters being possible when using the preferred multiple segment cold-wall crucible 10 and the specified frequency range for the coil 12. In addition, the cross-section of the stock can differ, e.g., square stock and air foil geometries can be produced by the method of this invention. Finally, those skilled in the art will appreciate that the form of the electromagnetic field generated by the induction coil can be tailored by changing the geometry of the coil and/or the crucible design. It is also foreseeable that the equipment used to melt and levitate the material could also differ from that noted and represented in FIG. 1, as long as a correct frequency is used with a suitable segmented crucible.

Therefore, while the invention has been described in terms of a preferred embodiment, other forms could be adopted by one skilled in the art. Accordingly, the scope of the invention is to be limited only by the following claims.

What is claimed is:

1. A method for directionally solidifying a reactive, refractory molten material to form a directionally-solidified, reactive, refractory composite material, the method comprising the steps of:

melting a reactive, refractory material within a vertical, multiple-segment, cold-walled, water-cooled, copper crucible to yield a melt;

at least partially levitating the melt by applying an electromagnetic field to at least partially levitate the melt within the vertical, multiple-segment, cold-walled, water-cooled, copper crucible;

solidifying the material;

remelting the solidified material, where the step of remelting the solidified material homogenizes the material; and separating the vertical, multiple-segment, cold-walled, water-cooled, copper crucible from the electromagnetic field so as to cause directional solidification of the melt in the vertical, multiple-segment, cold-walled, water-cooled, copper crucible and thereby form a directionally solidified article, where the article comprises a reactive, refractory composite material.

2. A method according to claim 1, wherein the reactive, refractory molten composite material comprises a multiphase material.

3. A method as recited in claim 1, wherein the material is selected from the group consisting of reactive metal-base alloys having a melting temperature of greater than about 1700° C.

4. A method as recited in claim 1, wherein the article is a monolithic material.

5. A method as recited in claim 1, wherein the article is an in-situ composite material.

6. A method as recited in claim 1, further comprising repeating the steps of solidifying and remelting the material prior to the step of separating.

7. A method as recited in claim 1, wherein the melt does not contact a peripheral wall of the vertical, multiple-segment, cold-walled, water-cooled, copper crucible throughout the melting and separating steps.

8. A method as recited in claim 1, wherein the separating step entails withdrawing the vertical, multiple-segment, cold-walled, water-cooled, copper crucible from the electromagnetic field.

9. A method as recited in claim 1, wherein the separating step entails relative movement between the vertical, multiple-segment, cold-walled, water-cooled, copper crucible and the electromagnetic field at a rate of about one to about thirty millimeters per minute.

10. A method as recited in claim 1, wherein the melt is heated by an induction coil that surrounds the vertical, multiple-segment, cold-walled, water-cooled, copper crucible and generates the electromagnetic field.

11. A method for directionally solidifying a reactive, refractory molten material to form a directionally-solidified, reactive, refractory composite material, the method comprising the steps of:

providing a vertical, multiple-segment, cold-walled, water-cooled, copper crucible comprising a base and a wall that define an interior of the crucible;

melting by induction heating a reactive material within the crucible to yield a melt;

at least partially levitating the melt by applying an electromagnetic field to partially levitate the melt within the container such that the melt does not contact the wall of the crucible;

solidifying the material;

remelting the solidified material, where the step of remelting the solidified material homogenizes the material; and withdrawing the crucible from the applied induction heating and the electromagnetic field so as to cause directional solidification of the melt in the crucible and form a directionally solidified article, where the article comprises a refractory composite material.

12. A method as recited in claim 11, wherein the material is selected from the group consisting of reactive materials having a melting temperature of greater than about 1700° C.

13. A method as recited in claim 11, wherein the article is a monolithic material.

14. A method as recited in claim 11, wherein the article is an in-situ composite material.

15. A method as recited in claim 11, wherein melting and levitation of the reactive material is induced by an induction heating device operating at a frequency of about 5 kHz to about 500 kHz.

* * * * *